United States Patent [19]

Okuno

[11] 4,116,685

[45] Sep. 26, 1978

[54] TOOL STEEL FOR WARM AND HOT WORKING

[75] Inventor: Toshio Okuno, Yasugi, Japan

[73] Assignee: Hitachi Metals, Ltd., Japan

[21] Appl. No.: 789,993

[22] Filed: Apr. 22, 1977

Related U.S. Application Data

[63] Continuation-in-part of Ser. No. 642,718, Dec. 22, 1975, abandoned.

[30] Foreign Application Priority Data

Dec. 27, 1974 [JP] Japan ..... 49-148981

[51] Int. Cl.$^2$ ..... C22C 38/44; C22C 38/46; C22C 38/52

[52] U.S. Cl. ..... 75/128 B; 75/128 V; 75/128 W

[58] Field of Search ..... 75/128 B, 128 V, 128 W; 148/36

[56] References Cited

U.S. PATENT DOCUMENTS

| | | | |
|---|---|---|---|
| 1,982,421 | 11/1934 | Emmons | 75/128 V |
| 2,147,120 | 2/1939 | Emmons | 75/128 V |
| 2,183,014 | 12/1939 | Emmons | 75/128 V |
| 2,666,697 | 1/1954 | Eder | 75/128 V |
| 3,928,025 | 12/1975 | Okuno et al. | 75/128 W |

FOREIGN PATENT DOCUMENTS

| | | | |
|---|---|---|---|
| 248,238 | 3/1968 | U.S.S.R. | 75/126 C |

*Primary Examiner*—Arthur J. Steiner
*Attorney, Agent, or Firm*—Craig & Antonelli

[57] ABSTRACT

The present invention relates to a tool steel for warm and hot working which consists essentially of, by weight, 0.50 - 1.00% of C, up to 1.50% of Si, up to 1.50% of Mn, 0.70 - 1.50% of Ni, 3.00 - 4.50% of Cr, 1.3 - 5.0% of W, 4.2 - 9.0% of Mo, 1.30 - 3.00% of V, 0.9 - 6.0% of Co, and the balance essentially Fe and impurities and $0.15 + 0.2\,V \leqq C \leqq 0.42 + 0.2\,V$. This tool steel is especially high in warm and hot strengths and abrasion resistance and has excellent toughness and hardenability.

4 Claims, No Drawings

TOOL STEEL FOR WARM AND HOT WORKING

CROSS REFERENCE TO THE RELATED APPLICATION

This is a continuation-in-part of the U.S. Ser. No. 642,718 filed on Dec. 22, 1975, now abandoned.

BACKGROUND OF THE INVENTION

The present invention relates to a tool steel for warm and hot working which is especially high in warm and hot strengths and abrasion resistance and has excellent toughness and hardenability.

Metallic mold for warm forging and hot precision press forging is required to be especially excellent in hot or warm strength and abrasion resistance because of severe requirement for high accuracy in size of material to be molded. At present, AISI M2 (JIS SKH 9) which has an excellent toughness as high speed steel for cutting tool is used and AISI M35 (JIS SKH 55) which corresponds to said AISI M2 to which Co is added are used.

However for some uses, the AISI M2 alloys are not sufficient in abrasion resistance. The AISI M35 alloy is not sufficient in toughness and early heat cracks and large cracks sometime occur. Furthermore, for some uses, a toughness of higher than that of AISI M2 is required and when amount of carbon is decreased for this purpose, the abrasion resistance becomes insufficient. Thus, sufficient practical steel life has not been obtained.

Moreover, AISI M2 and M35 are low in hardenability and when they are used for metallic molds of middle-large size, their essential characteristics cannot be easily exhibited.

SUMMARY OF THE INVENTION

It is the object of the present invention to provide a high efficiency tool steel for warm and hot working which has high warm and hot strengths as well as excellent toughness, which, when used as a material for a mold, forms a dense and adherent protective film on the surface due to elevation of temperature while being used and exhibits more excellent abrasion resistance due to also the distribution of carbides of high hardness to result in no early heat cracks and large cracks and to give a long life and which has a hardenability sufficient for metallic mold.

DETAILED DESCRIPTION OF THE INVENTION

The above object can be accomplished by providing a tool steel for warm and hot working which consists essentially of, by weight, 0.50 - 1.00% of C, up to 1.50% of Si, up to 1.50% of Mn, 0.70 - 1.50% of Ni, 3.00 - 4.50% of Cr, 1.3 - 5.0% of W, 4.2 - 9.0% of Mo, 1.30 - 3.00% of V, 0.9 - 6.0% of Co and the balance essentially Fe and incidental impurities and $0.15 + 0.2\,V \leqq C \leqq 0.42 + 0.2\,V$ and which has high warm and hot strength, high toughness, excellent abrasion resistance and sufficient hardenability and possesses a long life when used as a hot working tool.

The chemical composition of the present steel has, as basic components, middle to high C - middle to low Cr - W - Mo - Ni - V - Co to which Si and Mn are added. Addition of Ni as a basic component causes increase in toughness or results in high abrasion resistance without reduction in toughness and moreover can provide sufficient hardenability as a metallic mold materials. Addition of middle to small amount of Cr and relatively large amount of W, Mo and V provides temper softening resistance, hot strength and abrasion resistance, imparts proper oxidation characteristic to make it easy to produce oxide film on the surface of the mold due to elevation of temperature while being used. Furthermore, addition of Ni and Co renders the oxide film dense and adherent and lubricating action and heat insulating effect of said film cause great improvements in warm and hot abrasion resistance, corrosion resistance and resistance to surface roughness. Addition of Ni can provide a high abrasion resistance without lowering toughness and heat crack resistance and moreover impart hardenability necessary as metallic mold.

Furthermore, oxidation characteristic, hardenability, etc. can be controlled to proper values by adjusting the amount of Si and Mn.

Regarding the difference in effects of W and Mo, the effect of W in improving the hot strength and wear resistance at high temperature region is greater than that of Mo, but the carbide structure when amount of addition is large is apt to become coarse and in this case there may be disadvantage in toughness and in heat treating operation due to shift of quenching temperature to higher side. Furthermore, addition of Mo alone in a large amount may provide disadvantage in oxidation resistance and decarburization resistance at high temperature. In order to maintain good toughness and to increase hot hardness and seizing critical load ratio, it is necessary that W and Mo are jointly contained in proper ranges and are not singly contained.

Table 1 shows chemical compositions of the present steels, comparative steels and conventional steel.

Table 1

| | | Chemical composition (%) | | | | | | | | |
|---|---|---|---|---|---|---|---|---|---|---|
| | | C | Si | Mn | Ni | Cr | W | Mo | V | Co |
| The present steel | No. 1 | 0.66 | 1.05 | 0.85 | 0.84 | 3.43 | 3.32 | 5.82 | 1.71 | 1.42 |
| " | 2 | 0.78 | 0.30 | 0.77 | 1.30 | 3.71 | 4.46 | 7.35 | 1.89 | 5.46 |
| " | 3 | 0.77 | 0.28 | 0.75 | 1.13 | 3.77 | 4.41 | 7.32 | 1.92 | 3.49 |
| " | 4 | 0.76 | 0.29 | 0.76 | 1.34 | 3.75 | 4.47 | 7.25 | 1.91 | 3.52 |
| " | 5 | 0.79 | 0.33 | 0.78 | 0.77 | 3.75 | 4.51 | 7.37 | 1.93 | 3.51 |
| " | 6 | 0.78 | 0.31 | 0.77 | 1.32 | 3.73 | 4.48 | 7.38 | 1.91 | 3.34 |
| " | 7 | 0.79 | 0.34 | 0.78 | 1.31 | 3.74 | 4.50 | 7.37 | 1.90 | 1.63 |
| " | 8 | 0.79 | 0.35 | 0.72 | 1.28 | 3.70 | 4.51 | 7.32 | 1.91 | 1.14 |
| " | 9 | 0.68 | 0.35 | 0.82 | 0.83 | 3.41 | 1.34 | 5.91 | 1.72 | 1.40 |
| " | 10 | 0.67 | 0.32 | 0.81 | 0.83 | 3.39 | 4.48 | 5.88 | 1.69 | 1.43 |
| " | 11 | 0.67 | 0.30 | 0.77 | 0.82 | 3.40 | 1.93 | 4.53 | 1.65 | 1.42 |
| " | 12 | 0.65 | 0.29 | 0.78 | 0.80 | 3.38 | 1.96 | 7.66 | 1.70 | 1.39 |
| " | 13 | 0.68 | 0.31 | 0.76 | 0.79 | 3.41 | 1.90 | 8.78 | 1.72 | 1.44 |
| " | 14 | 0.56 | 0.30 | 0.78 | 0.84 | 3.55 | 1.48 | 4.36 | 1.77 | 4.58 |
| The present steel | No. 15 | 0.58 | 0.27 | 0.81 | 0.82 | 3.51 | 1.46 | 4.78 | 1.74 | 4.59 |
| " | 16 | 0.61 | 0.34 | 0.75 | 0.96 | 3.25 | 1.72 | 4.61 | 1.73 | 1.63 |

Table 1-continued

| | | Chemical composition (%) | | | | | | | | |
|---|---|---|---|---|---|---|---|---|---|---|
| | | C | Si | Mn | Ni | Cr | W | Mo | V | Co |
| " | 17 | 0.65 | 0.63 | 0.87 | 0.81 | 3.40 | 3.25 | 5.96 | 1.74 | 1.38 |
| Comparative steel | No. 20 | 0.79 | 0.35 | 0.79 | 0.51 | 3.72 | 4.43 | 7.31 | 1.91 | 3.56 |
| " | 21 | 0.76 | 0.32 | 0.76 | 1.81 | 3.70 | 4.47 | 7.33 | 1.90 | 3.50 |
| " | 22 | 0.78 | 0.31 | 0.79 | 2.15 | 3.68 | 4.43 | 7.41 | 1.87 | 3.42 |
| " | 23 | 0.79 | 0.33 | 0.77 | 1.32 | 3.74 | 4.49 | 7.42 | 1.92 | 9.11 |
| " | 24 | 0.79 | 0.33 | 0.75 | 1.29 | 3.75 | 4.45 | 7.40 | 1.92 | 7.87 |
| " | 25 | 0.80 | 0.29 | 0.74 | 1.26 | 3.68 | 4.42 | 7.41 | 1.93 | 0.81 |
| " | 26 | 0.67 | 0.34 | 0.78 | 0.86 | 3.40 | 0.51 | 5.94 | 1.73 | 1.45 |
| " | 27 | 0.69 | 0.38 | 0.79 | 0.81 | 3.42 | 5.85 | 5.75 | 1.70 | 1.41 |
| " | 28 | 0.65 | 0.32 | 0.83 | 0.84 | 3.44 | 1.95 | 3.77 | 1.68 | 1.39 |
| " | 29 | 0.69 | 0.28 | 0.79 | 0.81 | 3.45 | 1.91 | 10.68 | 1.67 | 1.38 |
| " | 30 | 0.62 | 0.33 | 0.74 | 0.98 | 1.95 | 1.68 | 4.65 | 1.75 | 1.57 |
| " | 31 | 0.64 | 0.61 | 0.85 | 0.43 | 3.42 | 3.28 | 5.98 | 1.71 | 1.42 |
| " | 32 | 0.66 | 0.65 | 0.89 | — | 3.45 | 3.21 | 6.01 | 1.73 | 1.45 |
| Comparative steel | No. 33 | 0.81 | 0.46 | 0.71 | 1.27 | 3.95 | 4.42 | 7.21 | 2.01 | — |
| " | 34 | 0.57 | 0.31 | 0.80 | 0.81 | 3.52 | — | 4.45 | 1.75 | 4.56 |
| " | 35 | 0.55 | 0.25 | 0.77 | 0.80 | 3.50 | 3.36 | 2.88 | 1.73 | 4.53 |
| Conventional steel | No. 40 | 0.88 | 0.21 | 0.30 | — | 3.90 | 6.67 | 5.25 | 2.14 | — |

Table 2 shows heat treating conditions.

Table 2

| | | Heat treating conditions | |
|---|---|---|---|
| | | Quenching (° C) | Tempering (° C) |
| The present steel | No. 1 | 1190 | 560 |
| " | 2 | 1200 | 580 |
| " | 3 | " | " |
| " | 4 | " | " |
| " | 5 | " | " |
| " | 6 | " | " |
| " | 7 | " | " |
| " | 8 | " | " |
| " | 9 | 1175 | 560 |
| " | 10 | 1190 | 570 |
| " | 11 | 1170 | 560 |
| " | 12 | 1190 | " |
| " | 13 | 1200 | " |
| " | 14 | 1165 | " |
| " | 15 | 1170 | " |
| " | 16 | 1165 | " |
| " | 17 | 1190 | " |
| Comparative steel | No. 20 | 1200 | 580 |
| " | 21 | 1190 | " |
| " | 22 | 1180 | 570 |
| " | 23 | 1210 | 580 |
| " | 24 | " | " |
| Comparative steel | No. 25 | 1200 | 580 |
| " | 26 | 1165 | 560 |
| " | 27 | 1200 | 580 |
| " | 28 | 1170 | 560 |
| " | 29 | 1210 | " |
| " | 30 | 1160 | " |
| " | 31 | 1190 | " |
| " | 32 | " | " |
| " | 33 | 1200 | 570 |
| " | 34 | 1155 | 560 |
| " | 35 | 1165 | " |
| Conventional steel | No. 40 | 1200 | 570 |

Table 3 shows hot hardness of the samples of the present steel. The present steels can have the hot strength equal to or much higher than that of the conventional steels depending on combination of components.

Comparison of the present steels No. 1, 9 and 10 and the comparative steels No. 26 and 27 shows that W has the great effect of increasing hot strength and this effect can be recognized even at the content of 0.51%, but is conspicuously increased at 1.34%. Therefore, the present steel requires at least 1.30% of W.

Moreover, comparison of the present steels No. 11 – 13 and the comparative steels No. 28 and 29 shows that Mo has an effect of increasing hot strength and in these steels, hot strength of high level cannot be provided at 3.77%, but a high hot strength is obtained at 4.53%. Therefore, the present steel requires at least 4.20% of Mo.

Comparison of the present steels No. 14 and 15 and the comparative steels No. 34 and 35 shows that the present steels which contain jointly W and Mo within the content ranges as specified in the present invention have higher hot hardness than the comparative steels which contain Mo only and those which contain jointly Mo and W, but Mo content being outside the range of the present invention.

Table 3

| | | 650° C Hot hardness (Hv) |
|---|---|---|
| The present steel | No. 1 | 384 |
| " | 2 | 407 |
| " | 5 | 404 |
| " | 6 | 402 |
| " | 7 | 400 |
| " | 9 | 380 |
| " | 10 | 389 |
| " | 11 | 378 |
| " | 12 | 386 |
| " | 13 | 388 |
| " | 14 | 380 |
| " | 15 | 382 |
| Comparative steel | No. 26 | 361 |
| " | 27 | 393 |
| " | 28 | 345 |
| " | 29 | 396 |
| " | 33 | 400 |
| " | 34 | 360 |
| " | 35 | 373 |
| Conventional steel | No. 40 | 380 |

Table 4 shows seizing critical load (ratio) of the present steels and the conventional steels at hot seizing abrasion test. The heat treating conditions were the same as in Table 2.

Table 4

| | | Seizing critical load ratio |
|---|---|---|
| The present steel | No. 1 | 121 |
| " | 2 | 170 |
| " | 6 | 163 |
| " | 7 | 159 |
| " | 8 | 155 |
| " | 14 | 146 |
| " | 15 | 151 |
| " | 17 | 124 |
| Comparative steel | No. 23 | 191 |
| Comparative steel | No. 24 | 188 |
| " | 25 | 146 |
| " | 31 | 119 |
| " | 32 | 117 |
| " | 33 | 141 |
| " | 34 | 135 |
| " | 35 | 143 |
| Conventional steel | No. 40 | 100 |

The samples of the steels were in the form of column and after heat treatment and final polishing, they were previously subjected to air oxidizing treatment at 540° C. End of these samples while being rotated at high speed was pressed against a steel heated to 700° C and the maximum load (critical load) by which the seizing did not occur was measured. Seizing critical loads of the conventional steels No. 40 was taken as 100 and those of the present steels were shown by relative value.

It is clear that the present steels were higher than the conventional steels in seizing critical load. This is because of the high abrasion resistance obtained by distribution of carbides and high hot strength and protective and lubrication actions of dense oxide film which was formed on the surface of the present steels and which was difficulty exfoliated. This is one of the great characteristics of the present invention.

Comparison of the present steels No. 2 and 6 – 8 and the comparative steels No. 23 – 25 and 33 shows that Co has the effect of increasing seizing critical load ratio and this effect is recognized even at the content of 0.81%, but the seizing critical load ratio is greatly improved between 0.81 – 1.14%. Therefore, the present steel requires at least 0.9% of Co.

Comparison of the present steel No. 17 and the comparative steels No. 31 and 32 shows that addition of Ni has the effect of improving the seizing critical load ratio, namely, abrasion resistance at high temperatures and this effect is slight at the content of 0.43%, but clearly recognized at 0.81%. Furthermore, it is necessary that the present steel contains at least 0.70% of Ni for attaining improvement of toughness due to the addition of Ni as shown in Table 5.

From the comparison of the present steels No. 14 and 15 and the comparative steels No. 34 and 35 in Table 3 it is recognized that it is necessary for increasing hot hardness to contain jointly W and Mo while comparison of the steels No. 14 and 15 and No. 34 and 35 in Table 4 shows that effect of joint addition of W and Mo is superior to that of single addition of W or Mo on the seizing critical load ratio, too.

Table 5 shows breaking toughness (ASTM, E399 test piece) of the present and conventional steels.

Table 5

| | | Breaking toughness $kg/mm^2 \cdot \sqrt{mm}$ |
|---|---|---|
| The present steel | No. 1 | 100 |
| " | 2 | 82 |
| " | 3 | 89 |
| " | 4 | 87 |
| " | 5 | 85 |
| " | 6 | 87 |
| " | 7 | 89 |
| " | 8 | 92 |
| " | 9 | 102 |
| " | 10 | 98 |
| " | 11 | 111 |
| " | 12 | 98 |
| " | 13 | 94 |
| Comparative steel | No. 20 | 81 |
| " | 21 | 84 |
| " | 22 | 85 |
| " | 23 | 69 |
| " | 24 | 75 |
| " | 25 | 94 |
| " | 26 | 108 |
| " | 27 | 90 |
| " | 28 | 114 |
| " | 29 | 87 |
| " | 33 | 94 |
| Conventional steel | No. 40 | 84 |

The steel of the present invention contains Ni as one of the basic components to improve resistance to cracks and reduction in breaking toughness caused by high C high alloy or by addition of CO is small. This is also one of the characteristics of the present invention.

Comparison of the present steels No. 2 – 4 and the comparative steel No. 20 shows that reduction in toughness is remarkable at Ni content of 0.74 – 0.51% and so the present steel requires at least 0.70% of Ni. Moreover, comparison of the present steels No. 2 and 5 – 7 and the comparative steels No. 23 – 25 shows that tendency of reduction in toughness due to increase in Co content is relatively small at not more than 5.46% of Co content, but the reduction is considerably great at 7.87% to damage the characteristic of the present steel, namely, high toughness. Therefore, the Co content should be not more than 6.0% in the present steel.

From comparison of the present steels No. 1, 8 and 9 and the comparative steels No. 26 and 27, it is recognized that reduction of toughness is relatively small at the W content of up to 4.48% and is great at 5.85%. Therefore, the W content should be not more than 5.0% because of the characteristic of high toughness taking into consideration the segregation in steel materials of large size. Furthermore, from comparison of the present steels No. 11 – 13 and the comparative steels No. 28 and 29, reduction of toughness is relatively small at Mo content of up to 8.78% and the reduction becomes great at Mo content of 10.68%. Thus, the Mo content should be not more than 9.0% considering the segregation in steels of large size.

Table 6 shows breaking toughness of samples which were quenched from 1170° C at half cooling time of 15 minutes (which means quenching cooling rate which requires 15 minutes for reduction from the quenching temperature until an intermediate temperature between the quenching temperature and room temperature, namely, quenching of substantial metallic mold having mass being supposed.) and then were tempered to $H_RC$ 61.

Table 6

| | Breaking toughness $kg/mm^2 \cdot \sqrt{mm}$ |
|---|---|
| The present steel No. 16 | 125 |
| Comparative steel No. 30 | 80 |

The comparative steel No. 30 contains 1.95% of Cr and toughness is markedly low which is due to formation of incompletely quenched structure mainly composed of grain boundary portion due to incomplete quenching and this steel has no sufficient hardenability for practical metal molds. In the case of warm or hot metal molds of practical sizes, the hardenability has very important meaning and the present steel requires at least 3.0% of Cr for imparting sufficient hardenability for practical metal molds.

Table 7 shows machinability index which indicates tool life in machinability test when that of the present steel No. 5 is taken as 100.

Table 7

| | | |
|---|---|---|
| The present steel | No. 2 | 88 |
| " | 3 | 91 |
| " | 4 | 89 |
| " | 5 | 100 |
| Comparative steel | No. 20 | 103 |
| " | 21 | 69 |

Table 7-continued

| | | |
|---|---|---|
| " | 22 | 61 |

Comparison of the present steels No. 2 – 4 and the comparative steel No. 20 in Table 5, it is recognized that the lower limit of Ni content should be 0.70% for maintaining good toughness. On the other hand, from the steels No. 2 – 4 and 20 in Table 7, it is recognized that increase of Ni content causes reduction of machinability and the reduction is not so great at Ni content of 1.30%, but is great at 1.81% and thus upper limit of Ni content should be 1.50%.

Table 8 shows heat crack resistance of the present steels. The test pieces of 15 mmϕ × 25 mml were rapidly heated to 650° C and rapidly cooled to 20° C in water. This treatment was repeated 1000 times on one test piece. The results are shown in Table 8.

Table 8

| | | The number of cracks | Average depth of cracks (mm) | Maximum length of cracks (mm) |
|---|---|---|---|---|
| The present steel | No. 1 | 118 | 0.036 | 0.11 |
| " | 12 | 116 | 0.040 | 0.13 |
| Conventional steel | No. 40 | 113 | 0.062 | 0.21 |

The above results are due to the high resistance to crack development and protective action and heat insulating effect of the oxide film formed by heating.

Table 9 shows the comparison of quenching hardness of central part of a sample of 250 mmϕ which was oil quenched with that of a small sample.

Table 9

| | Oil quenching hardness of central part of steel of 250 mm in diameter ($H_RC$) | Oil quenching hardness of steel of 10 mm in diameter ($H_RC$) |
|---|---|---|
| The present steel No. 8 | 60.0 | 62.8 |
| Conventional steel No. 40 | 57.2 | 64.1 |

It is clear that the present steel is higher than the conventional steel in quenching hardness of the central part. That is, in the case of the steel of middle to large size, there occurs no reduction in hardness and toughness due to incomplete quenching (intergranular precipitation, etc.) and the inherent toughness can be exhibited.

Reasons for limitation of content of each component in the present steel are explained below.

C is added for maintaining the high quenching hardness and temper hardness of the present steel, for producing carbides by binding carbide-forming elements such as W, Mo, V and Cr to result in refining of crystal grains, abrasion resistance, temper softening resistance and hot hardness.

Regarding the balance of C - V, in the case of the present steels No. 1 – 17 which are in the range of high alloy, it is usual to make C content lower than that of cutting high speed steels, but for some specific uses, the C content in the present steel of high toughness can be equal or higher than that of the cutting high speed steel.

When the balance of toughness and abrasion resistance is important, content of C is 0.50 – 1.0%, more preferably 0.50 – 0.90%. When content of carbon is too much, toughness is decreased and hence it is up to 1.0%, more preferably up to 0.90%. On the other hand, when the carbon content is too low, the effect of addition is not obtained and hence it is at least 0.50% preferably 0.6%. Moreover, the steel of the present invention is required to stand severe forging stress, thermal shock, thermal influence of high temperatures when used as metallic mold. For this purpose, from the point of structure, matrix structure and toughness, it is important to control C - V balance to $0.15 + 0.2\,V \leqq C \leqq 0.42 + 0.2\,V$.

Si is apt to decrease thickness of the oxide film formed at elevation of temperature while being used and is added taking into consideration the use, elevating temperature, and atmosphere for use. For some uses, Si is added in a large amount to increase toughness. When Si content is too high, amount of the oxide film is too small and hence Si is added in an amount of up to 1.5%, preferably up to 1.00%.

Mn has the effect of increasing the amount of the oxide film and furthermore has the effect of improving hardenability. When Mn content is too high, $A_1$ transformation point becomes too low, annealing hardness is increased and workability is lowered. Therefore, the Mn content is up to 1.50%, more preferably up to 1.20%.

Ni is the most important basic element for imparting a sufficient hardenability for metallic mold material, a high hot strength and excellent toughness and for forming a protective adherent oxide film together with Co due to elevation of temperature while being used to increase warm and hot abrasion resistance and heat crack resistance and to prevent formation of crack developing nucleuses. Improvement in abrasion resistance without reducing toughness by addition of Co becomes possible by the addition of Ni. This is a great characteristic of the present steel. The addition of Ni not only improves toughness, but, as an austenite forming element, makes it possible to reduce carbon content without causing disadvantages such as precipitation of ferrite, reduction in hardenability, etc. From this aspect, too, Ni makes it possible to obtain mold materials of high toughness, Ni has the effects as mentioned above and when Ni content is too high, $A_1$ transformation point is decreased and annealing hardness becomes excessively high to reduce machinability. Therefore, Ni content is up to 1.50%. When it is too low, said effects cannot be obtained. Therefore, the content is at least 0.70%.

Cr in a suitable amount has the effects of improving temper softening resistance and hot strength, imparting proper oxide film characteristic, improving abrasion resistance by forming carbides in combination with C, increasing $A_1$ transformation point, improving hardenability and imparting rapid nitriding characteristic. When Cr content is too low, oxidation resistance is insufficient, surface roughness is apt to occur, hardenability is lowered, $A_1$ transformation point is lowered and abrasion resistance is decreased. Therefore, lower limit of Cr content is 3.00%. On the other hand, when Cr content is too high, oxidation resistance becomes excessively great to make it difficult to produce the protective oxide film, precipitation and cohesion of carbides are accelerated to reduce temper softening resistance and hot strength. Thus, upper limit of Cr content is 4.5%.

W forms carbides in a large amount which hardly forms solid solution in matrix at heating for quenching to provide a peculiar effect on improvement in abrasion resistance, furthermore it precipitates fine carbides at tempering to increase high temperature yield strength and moreover it increases denseness of surface oxide film formed at elevation of temperature while being used. Effect of W with reference to oxide film characteristics varies depending on relation with amount of Cr, Mo, Si, Mn, Ni, Co and V and proper combination of these elements results in the excellent abrasion resistance as shown in Table 4.

In order to obtain the effect mentioned above, the lower limit of W is restricted to 1.3% and the upper limit of W is restricted to 5.0% taking into consideration the reduction of toughness due to increase of W. More preferred range of W content is 1.3 - 3.5%. When high toughness is required considering segregation in steel materials of large size, the W content is 1.5 - 3.0% and when high hot strength is especially desired, it is 2.5 - 5.0%.

Like W explained above, Mo forms carbides to increase abrasion resistance, which forms solid solution in matrix to improve hardenability, precipitates fine carbides at tempering to increase temper softening resistance and hot strength and makes it easy to form the protective oxide film while being used.

In order to obtain the above mentioned effects, the lower limit of Mo is restricted to 4.2% and the upper limit of Mo is restricted to 9.0% taking into consideration the reduction of toughness due to increase of Mo content. More preferred Mo content is 4.6 - 8.0%. When high toughness is required considering segregation in steels of large size, the Mo content is 4.6 - 5.5% and when high hot strength is required, it is 5.5 - 8.0%.

In order to maintain good toughness and to increase hot hardness and seizing critical load ratio, it is necessary that the steel should contain jointly 1.3 - 5.0% of W and 4.2 - 9.0% of Mo and should not contain W or Mo alone.

V is an important element in that it forms difficultly soluble carbides in a large amount to increase abrasion resistance and thermal shock resistance, it forms solid solution in matrix at heating for quenching to precipitate fine and difficultly cohesive carbides at tempering and it increases softening resistance at a high temperature range to impart great high temperature yield strength. Furthermore, V has the effects of refining crystal grains to increase toughness and to raise $A_1$ transformation point and improving heat crack resistance as well as high temperature yield strength. When V content is too high, amount of carbides becomes too large and coarse carbides are produced to lower toughness and workability and when it is too low, these effects cannot be obtained. Therefore, V content is up to 3.00% and at least 1.30%. Preferred range is 1.30 - 2.50%. When the toughness is taken into consideration, more preferred range is 1.30 - 2.00%. When the abrasion resistance is taken into consideration, more preferred range is 1.50 - 2.50%.

Co is added for providing markedly high abrasion resistance of the present steel at a high temperature. In the present steel, it is a great characteristic that the effect of increasing abrasion resistance by the addition of Co is exhibited without lowering toughness by jointly adding Ni. By the addition, of Co, extremely dense and highly adherent protective oxide film is formed at elevation of temperature while being used, whereby direct contact with material to be treated and elevation of temperature at the surface of metallic mold are prevented and excellent abrasion resistance is provided. Furthermore, there are provided such effects as improvement in heat crack resistance and prevention of formation of crack developing nucleuses due to heat insulating and protective action of the oxide film. Co is added to obtain said effects and when Co content is too high, toughness is reduced and when too low, said effects cannot be obtained. Therefore, Co content is up to 6.00% and at least 0.90%. Preferred range is 0.90 - 3.50%. More preferred range, taking into consideration toughness and abrasion resistance, is 1.2 - 3.5%.

The following are preferred compositions of the present invention:

A tool steel consisting essentially of, by weight, 0.50 - 1.0% of C, up to 1.0% of Si, up to 1.20% of Mn, 0.7 - 1.5% of Ni, 3.0 - 4.5% of Cr, 1.3 - 3.5% of W, 4.2 - 6.5% of Mo, 1.30 - 2.50% of V, 0.9 - 3.5% of Co and the balance essentially Fe and impurities, contents of said C and V satisfying $0.15 + 0.2\,V \leqq C \leqq 0.42 + 0.2\,V$.

A tool steel consisting essentially of, by weight, 0.60 - 1.0% of C, up to 1.0% of Si, up to 1.20% of Mn, 0.7 - 1.5% of Ni, 3.0 - 4.5% of Cr, 2.5 - 5.0% of W, 5.5 - 8.0% of Mo, 1.5 - 2.50% of V, 1.2 - 3.5% of Co and the balance essentially Fe and impurities, contents of said C and V satisfying $0.15 + 0.2\,V \leqq C \leqq 0.42 + 0.2\,V$.

A tool steel consisting essentially of, by weight, 0.50 - 0.90% of C, up to 1.0% of Si, up to 1.20% of Mn, 0.7 - 1.5% of Ni, 3.0 - 4.5% of Cr, 1.5 - 3.0% of W, 4.6 - 5.5% of Mo, 1.3 - 2.0% of V, 1.2 - 3.5% of Co and the balance essentially Fe and impurities, contents of said C and V satisfying $0.15 + 0.2\,V \leqq C \leqq 0.42 + 0.2\,V$.

As described hereinbefore, the present steel is a high efficiency tool steel for warm and hot working which has extremely excellent warm and hot strength, abrasion resistance and toughness and moreover has a hardenability sufficient for metallic mold and a long life.

What is claimed is:

1. Tool steel for warm and hot working which consists essentially of, by weight, 0.50 - 1.0% of C, up to 1.50% of Si, up to 1.50% of Mn, 0.7 - 1.5% of Ni, 3.0 - 4.5% of Cr, 1.3 - 5.0% of W, 4.2 - 9.0% of Mo, 1.30 - 3.0% of V, 0.9 - 6.0% of Co and the balance essentially Fe and impurities, contents of said C and V satisfying $0.15 + 0.2\,V \leqq C \leqq 0.42 + 0.2\,V$.

2. Tool steel for warm and hot working which consists essentially of, by weight, 0.50 - 1.0% of C, up to 1.0% of Si, up to 1.20% of Mn, 0.7 - 1.5% of Ni, 3.0 - 4.5% of Cr, 1.3 - 3.5% of W, 4.2 - 6.5% of Mo, 1.30 - 2.50% of V, 0.9 - 3.5% of Co and the balance essentially Fe and impurities, contents of said C and V satisfying $0.15 + 0.2\,V \leqq C \leqq 0.42 + 0.2\,V$.

3. Tool steel for warm and hot working which consists essentially of, by weight, 0.60 - 1.0% of C, up to 1.0% of Si, up to 1.20% of Mn, 0.7 - 1.5% of Ni, 3.0 - 4.5% of Cr, 2.5 - 5.0% of W, 5.5 - 8.0% of Mo, 1.5 - 2.50% of V, 1.2 - 3.5% of Co and the balance essentially Fe and impurities, contents of said C and V satisfying $0.15 + 0.2\,V \leqq C \leqq 0.42 + 0.2\,V$.

4. Tool steel for warm and hot working which consists essentially of, by weight, 0.50 - 0.90% of C, up to 1.0% of Si, up to 1.20% of Mn, 0.7 - 1.5% of Ni, 3.0 - 4.5% of Cr, 1.5 - 3.0% of W, 4.6 - 5.5% of Mo, 1.3 - 2.0% of V, 1.2 - 3.5% of Co and the balance essentially Fe and impurities, contents of said C and V satisfying $0.15 + 0.2\,V \leqq C \leqq 0.42 + 0.2\,V$.

* * * * *